US005501153A

United States Patent [19]

Cassagne et al.

[11] Patent Number: 5,501,153

[45] Date of Patent: Mar. 26, 1996

[54] PYROTECHNICAL HEAD HAVING IMPROVED DISPERSAL MEANS

[75] Inventors: Philippe Cassagne, Saint Lys; Denis Dihlan, Auterive, both of France

[73] Assignee: Etienne Lacroix Tous Artifices S.A., Muret, France

[21] Appl. No.: 205,873

[22] Filed: Mar. 3, 1994

[30] Foreign Application Priority Data

Mar. 5, 1993 [FR] France ..... 93 02597

[51] Int. Cl.[6] ..... F42B 1/02; F42B 4/26; F42B 4/06

[52] U.S. Cl. ..... 102/307; 102/340; 102/342; 102/351; 102/357; 102/378

[58] Field of Search ..... 102/307, 340, 102/342, 351, 357, 378

[56] References Cited

U.S. PATENT DOCUMENTS

| | | | |
|---|---|---|---|
| 2,180,667 | 11/1939 | Decker | 102/340 |
| 3,101,053 | 8/1963 | Stevenson et al. | 102/57 |
| 3,103,388 | 9/1963 | Rosenthal | 102/66 |
| 4,354,433 | 10/1982 | Owen | 102/307 |
| 4,454,816 | 6/1984 | Billard et al. | 102/342 X |
| 4,505,203 | 3/1985 | Brady et al. | 102/293 X |
| 4,598,096 | 7/1986 | Grant | 102/512 X |
| 4,791,870 | 12/1988 | Simpson | 102/342 X |
| 5,040,465 | 8/1991 | Maury | 102/357 X |
| 5,076,171 | 12/1991 | Altenau et al. | 102/357 X |

FOREIGN PATENT DOCUMENTS

| | | | |
|---|---|---|---|
| 3920016 | 10/1991 | Germany . | |
| 1477097 | 6/1977 | United Kingdom | 102/378 |

*Primary Examiner*—Peter A. Nelson

*Attorney, Agent, or Firm*—Blakely, Sokoloff, Taylor & Zafman

[57] ABSTRACT

The invention relates to a pyrotechnical head of the type comprising an elongate envelope, a pyrotechnical composition contained in the envelope, and dispersal means for dispersing said pyrotechnical composition. The dispersal means include longitudinal detonating fuses adapted to split the envelope longitudinally, and a transverse detonating fuse adapted to split the envelope transversely.

15 Claims, 2 Drawing Sheets

PYROTECHNICAL HEAD HAVING IMPROVED DISPERSAL MEANS

The present invention relates to the field of pyrotechnical heads.

BACKGROUND OF THE INVENTION

More particularly, the present invention relates to a pyrotechnical head designed, on contact with or in the proximity of a target, mainly to disperse a pyrotechnical composition comprising one or more pyrotechnical substances selected as a function of the looked-for effect, which may be incendiary and/or incapacitating.

In order to increase the range of incendiary and/or incapacitating weapons, proposals have been made to mount a pyrotechnical head on a projectile, the head comprising an envelope filled with a pyrotechnical composition and with means for dispersing said composition over the target, which means are conventionally constituted by an explosive charge placed within the pyrotechnical composition. The envelope is ruptured under the effect of the pressure evolved during the explosion of the explosive charge. Known pyrotechnical heads of that type suffer from the drawback of giving rise to non-uniform bursting of the envelope so that the pyrotechnical composition is dispersed over directions and ranges that do not always correspond with the desired dispersal. In particular, during use of pyrotechnical compositions that include an incendiary substance, dispersal must not take place over too great a range, since the substance then becomes difficult to ignite, nor must its range be too confined, since there is then loss of effectiveness.

In order to remedy the above drawback, proposals have been made to pre-fragment the envelope in such a manner as to cause it to burst in a determined manner. Nevertheless, making a pre-fragmented envelope encounters the difficulty of achieving a compromise between dispersal range of the pyrotechnical composition and the extent to which the envelope is pre-fragilized. A powerful explosive charge based in a strong envelope generates high pressure before the envelope ruptures and thus disperses the pyrotechnical composition over a large range. In contrast, an envelope that has been pre-fragilized bursts at a lower pressure, thereby reducing the range over which the pyrotechnical composition is dispersed, while simultaneously providing less mechanical strength for withstanding the acceleration to which the projectile is subjected on being launched or on being handled. In addition, the machining done to pre-fragment an envelope must be accurate and is therefore expensive.

Publication U.S. Pat. No. 3,103,888 describes a pyrotechnical head comprising an elongate envelope, a smoke-generating pyrotechnical composition constituted by white phosphorus contained inside the envelope, and dispersal means for dispersing the composition and for splitting the envelope longitudinally. In that known pyrotechnical head, the dispersal means are disposed in such a manner that the white phosphorus is dispersed little and burns in the form of large lumps like smoke generator pots. Thus, that known head is unsuitable for an incendiary or incapacitating composition where dispersal over a greater range is looked for.

OBJECT AND SUMMARY OF THE INVENTION

The present invention seeks to provide a pyrotechnical head comprising an elongate envelope including a cylindrical body that is circularly symmetrical about an axis of symmetry, closed at the rear end by an end wall, a pyrotechnical composition contained in the envelope, and dispersal means for dispersing said pyrotechnical composition, the head remedying the above-specified drawbacks, in particular in that it does not require expensive machining to be manufactured, and in that it ensures uniform dispersal of the pyrotechnical composition over the largest possible range for the desired application.

According to the invention this is achieved by the fact that the dispersal means comprise longitudinal detonating fuses for splitting purposes adapted to split the envelope longitudinally, and a transverse detonating fuse for splitting purposes adapted to split the envelope transversely, said transverse detonating fuse for splitting purposes being placed at the periphery of the inside surface of the envelope in front of its end wall.

The transverse detonating fuse enables the rear of the envelope to be opened and in conjunction with the action of the longitudinal fuses it thus facilitates dispersal of the composition.

According to an advantageous characteristic of the invention, said pyrotechnical composition comprises an incendiary substance and a pyrogenic substance adapted to ignite the incendiary substance, the two substances being placed in separate compartments inside the envelope.

In a preferred embodiment, the front end of the envelope is closed by a nose that is generally outwardly convex in shape, said pyrogenic substance is placed in the nose of the envelope, and said incendiary substance is placed in the cylindrical body.

Advantageously, said pyrotechnical composition further comprises a lacrimatory substance placed in a compartment situated in the nose of the envelope, opposite to the compartment containing the incendiary substance.

Advantageously, the pyrotechnical head includes an explosive slug placed in front of the compartment containing said pyrogenic substance. Preferably, the explosive slug is placed between the compartment containing the lacrimatory substance and the compartment containing the pyrogenic substance.

Advantageously, the pyrotechnical head includes pyrotechnical initiation means extending forwards from the rear of the envelope up to the explosive slug. Preferably, said pyrotechnical initiation means are placed in the center of the envelope and extend along said axis of symmetry of the envelope.

According to another advantageous characteristic of the invention, the transverse detonating fuse is placed in the proximity of at least one longitudinal detonating fuse in such a manner that the transverse detonating fuse is initiated by the longitudinal detonating fuses.

Advantageously, the transverse detonating fuse is placed at a distance from the rear axial ends of the longitudinal detonating fuses, and is preferably placed at a distance lying between one-fourth and one-eight of the length thereof.

Advantageously, said pyrotechnical initiation means are placed in the proximity of the longitudinal detonating fuses in such a manner that said pyrotechnical initiation means initiate the longitudinal detonating fuses which in turn initiate the transverse detonating fuse.

According to another advantageous characteristic of the invention, the longitudinal detonating fuses are placed on the inside surface of the envelope.

Preferably, each of the longitudinal detonating fuses extends in a plane that contains the axis of symmetry of the envelope.

BRIEF DESCRIPTION OF THE DRAWINGS

Other characteristics and advantages of the present invention appear from reading the following detailed description of a non-limiting embodiment of the invention given with reference to the accompanying drawings, in which.

MORE DETAILED DESCRIPTION

Figure 1:
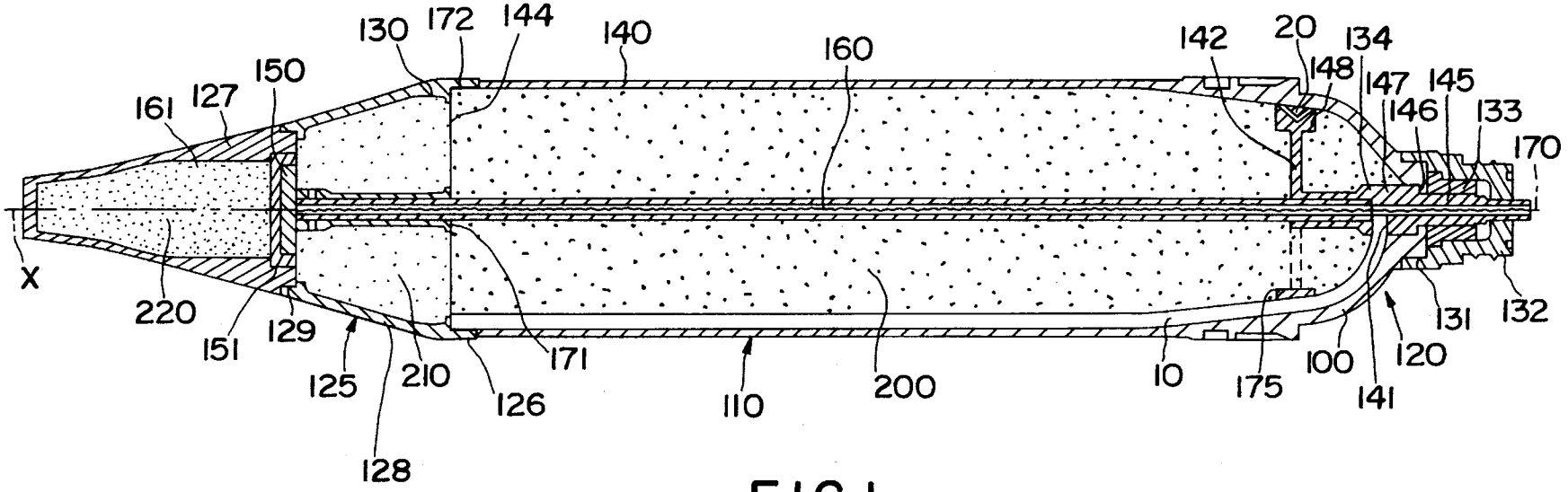
FIG. 1 is a longitudinal section on the axis of symmetry of the envelope of a pyrotechnical head in accordance with the invention.

FIG. 1 shows a pyrotechnical head, preferably designed to be fitted with known fins (not shown) to form a projectile.

In the description below, the terms "rear portion" and "front portion" are used respectively to designate those portions of the head that are closest to and furthest from said fins, the rear portion being situated to the right in FIG. 1.

The pyrotechnical head comprises an envelope 100 that is preferably circularly symmetrical about an axis referenced X and lying in the section plane of FIG. 1. The envelope 100 comprises a cylindrical body 110 that is circularly symmetrical about the axis X, that is extended rearwards by a portion whose shape is generally outwardly convex, that is circularly symmetrical about the axis X, and that is formed integrally with the cylindrical body 110 or that is added thereto. The front of the cylindrical body 110 is closed by a nose 125. The nose comprises a frustoconical intermediate hollow body 128 that is circularly symmetrical about the axis X, that is situated at the front of the cylindrical body 110 and that is screwed thereto at 126, together with a leading end hollow body 127 situated in front of the intermediate body 128 and screwed at 129 thereto. More particularly, the intermediate hollow body 128 has a frustoconical wall that flares rearwardly, being connected at its rear end to a wall 144 extending perpendicularly to the axis X and provided in its center with a circular passage 171, and with an internally threaded cylindrical skirt 172 that extends the outer periphery of the wall 144 rearwards for screwing onto the cylindrical body 110. The outside surface and the apex of the end wall 120 presents a threaded cylindrical flank 131 onto which a coupling piece 132 is screwed that has fins and/or means for propelling or guiding the head, that are known per se and that are not shown. The coupling piece 132 houses a nut 133 for holding a support element 134 that is described in greater detail below. In the embodiment described, the length of the cylindrical body 110 is slightly greater than three times its diameter, and the length of the nose 125 is equal to about half the length of the cylindrical body 110.

According to the invention, the envelope 100 contains a pyrotechnical composition together with dispersal means for dispersing the composition. More particularly, the dispersal means are constituted in the embodiment described by three longitudinal detonating fuses 10 for splitting purposes and adapted to split the envelope longitudinally parallel to the axis X, together with a transverse detonating fuse 20 also for splitting purposes and adapted to split the envelope transversely perpendicularly to the axis X. The three longitudinal detonating fuses are placed in three respective diametral planes each containing the axis of symmetry X and uniformly distributed around said axis, and only one of these longitudinal detonating fuses appears in the section view of FIG. 1.

Figure 2:
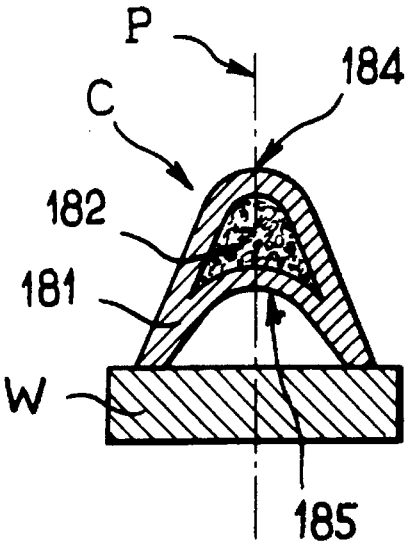
FIGS. 2 to 4 are right sections through a detonating fuse for splitting purposes, showing the effect on a wall of the fuse detonating.
Figure 3:
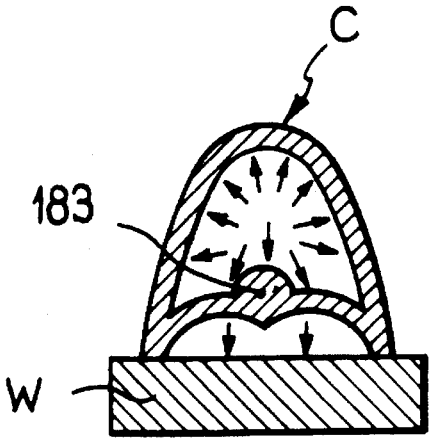
Figure 4:
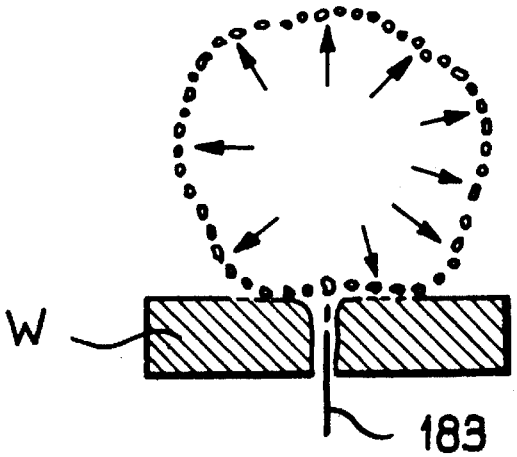

FIG. 2 is a right section through a splitting detonating fuse C that is known per se. The fuse is constituted by a metal sheath 181 of essentially triangular section having two flanks that slope relative to each other at an angle of close to 60°, with a rounded apex 184 that is outwardly convex and with a base 185 that is outwardly concave, the fuse being symmetrical about a bisector plane P that contains the apex 184, and that also constitutes a plane of symmetry for the sheath. The sheath is charged with an explosive 182. The outwardly directed concave base of the sheath 181 serves to concentrate its explosive power in the bisector plane P and to direct it towards a wall W on which the fuse is placed. The bisector plane P advantageously coincides with a diametral plane of the incendiary head for the longitudinal detonating fuses 10, and with a plane that is perpendicular to the axis X for the transverse detonating fuse 20. The metal sheath 181 is advantageously made of lead, and the explosive 182 is advantageously hexogen. FIGS. 3 and 4 show the behavior of the sheath 181 when the explosive 182 is detonated. Under the effect of detonation (FIG. 3) the base of the sheath 181 of each of the fuses is projected towards the wall W so as to form a sting 183 that pierces it (FIG. 4).

With reference again to FIG. 1, the transverse detonating fuse 20 is preferably situated (as shown) substantially level with the junction between the cylindrical body 110 and the end wall 120. The longitudinal detonating fuses 10 are placed on the inside surface of the envelope 100 and they extend over the entire length of the cylindrical body 110 and over the end wall 120. As a result, the transverse detonating fuse 20 crosses over the longitudinal detonating fuses 10, and in the crossover region there exists pyrotechnical contact or the "possibility of transferring fire" from the longitudinal detonating fuses 10 to the transverse detonating fuse 20, as explained below.

The support element 134, preferably made of composite material, comprises an elongate body that is generally tubular in shape, being circularly symmetrical about the axis X, and provided at its front end with an extension 142 extending radially to the inside surface of the envelope 100 at the junction between the cylindrical body 110 and the end wall 120. The element 134 has a central bore running lengthwise coaxially about the axis X, and pyrotechnical initiation means 160 as described in greater detail below pass therealong. The support element 134 includes a rear portion 145 extending beyond the envelope 100 via a hole provided through the end wall 120, having an outside thread and screwed into the nut 133. When the nut 133 is tightened, the element 134 comes axially into abutment via an enlarged portion 147 against an annular transverse rim 146 surrounding said hole formed through the end wall 120, on the inside of the envelope. The enlarged portion 147 includes radial openings opening into the central bore of the element 134 and in which the rear axial ends of the longitudinal detonating fuse 10 are engaged in order to come into pyrotechnical contact with the pyrotechnical initiation means 160. The extension 142 is formed of radial arms that carry an annular ring 148 serving as a support for the transverse detonating fuse 20. More particularly, the transverse detonating fuse is received in a housing formed on the radially outer surface of the ring 148 that is open towards the inside surface of the envelope. Longitudinal passages 175 are provided to enable the longitudinal detonating fuses 10 to pass through the ring 148. The longitudinal fuses are held against the inside surface of the envelope by adhesive or by any other suitable means known to the person skilled in the art.

In the embodiment described, the pyrotechnical composition comprises an incendiary substance 200. This incendiary substance is preferably based on gelled or liquid hydrocarbon that may be called "incendiary gel".

In order to increase the exothermal effect, a doping agent is advantageously incorporated in said incendiary gel, e.g. shavings of a reducing metal or alloy. While incandescent, these shavings are projected against the target and transmit their thermal energy thereto by conduction, thus adding to the heat transmitted by convection due to combustion of the burning gel. The incendiary substance 200 is contained in a compartment 140 that is longitudinally defined by the inside surface of the cylindrical body 110, that is defined axially at its rear end by the inside surface of the end wall 120, and at its front end by the wall 144 of the intermediate hollow body 128.

The incendiary substance 200 is ignited by a pyogenic substance 210 contained in a compartment 130 situated in front of the compartment 140 and separated therefrom by the above-mentioned wall 144. The pyrogenic substance is adapted to produce very intense thermal radiation, also known as a thermal "flash". It may be constituted, for example, by a powder mixture of an oxidizer and a reducer. The compartment 130 is formed inside the intermediate body 128 and it is defined longitudinally by the frustoconical wall of the hollow intermediate body 128, transversely at the rear by the wall 144 and at the front by the hollow end body 127. An explosive slug 150 represented highly diagrammatically in FIG. 1 is placed in front of the compartment 130 containing the pyrogenic substance 210 for the purpose of initiating combustion therein. The explosive slug 150 is preferably placed, as shown, in a bore 151 formed on the rear face of the end hollow body 127 and is disposed in said bore 151 in such a manner as to generate a shockwave that is directed mainly towards the rear. The explosive slug 150 is fired by pyrotechnical initiation means 160, preferably constituted by an explosive fuse coaxial with the axis X and having an axially front end in pyrotechnical contact with the explosive slug 150, and an axially rear end 170 in pyrotechnical contact with conventional firing means (not shown), e.g. comprising an inertia striker if the projectile is designed to explode on coming into contact with the target. The explosive fuse 160 is preferably placed in a support tube that is coaxial about the axis X and running through the incendiary substance 200 (not shown in FIG. 1).

The pyrotechnical composition preferably further comprises a lacrimatory substance 220 placed in the nose 125 of the pyrotechnical head. More particularly, the lacrimatory substance 220 is contained in a compartment 161 formed inside the end hollow body 127 that is defined longitudinally and to the front by the inside surface of the end hollow body 127, and transversely to the rear by the explosive slug 150. Thus, the explosive slug 150 is advantageously situated between the compartment containing the lacrimatory substance 220 and the compartment containing the pyogenic substance 210.

According to another advantageous characteristic of the invention, the transverse detonating fuse 20 is in pyrotechnical contact with the longitudinal detonating fuses 10 such that the transverse detonating fuse is initiated by the longitudinal detonating fuses. More particularly, in the embodiment described, the transverse detonating fuse is constituted by the combination of three circular arcuate segments centered about the axis X, each segment extending over the inside surface of the envelope between two of the longitudinal detonating fuses. In a variant, the transverse detonating fuse 20 could be implemented as a single piece, with the longitudinal detonating fuses then passing beneath the transverse detonating fuse in the crossover regions, appropriate reinforcement being provided on the inside surface of the envelope 100.

The pyrotechnical head operates as follows. As mentioned above, the pyrotechnical initiation means 160 are fired in conventional manner, e.g. by means of an inertia striker. The detonation as initiated at the rear end 170 of the pyrotechnical initiation means propagates forwards through the coupling piece 132, the nut 133 and the support element 134 until it reaches the axially rear ends 141 of the longitudinal detonating fuses. These fuses which are in pyrotechnical contact with the initiation means 160 are then initiated, causing them to detonate. The detonation of the initiation means 160 continues in a forwards direction while the longitudinal detonating fuses 10 split the end wall 120 of the envelope along three lines of split that are uniformly distributed angularly about the axis X. When the detonation of the longitudinal detonating fuses 10 reaches the transverse detonating fuse 20, it too is initiated in detonation and cuts off the end wall of the envelope in a plane perpendicular to the axis X. The rear of the envelope 100 is thus opened, thereby facilitating dispersal of the pyrotechnical composition contained inside the envelope, as explained below. The detonation of the initiation means 160 continues to propagate towards the explosive slug 150 while the longitudinal detonating fuses 10 split the cylindrical body 110 of the envelope 100 along three lines of split that are uniformly distributed angularly around the axis X, and that are parallel thereto. When the detonation of the initiation means 160 reaches the explosive slug 150, it is fired, giving rise to a shockwave that is directed essentially towards the rear, serving in particular to begin the reaction of the pyrogenic substance 210 and to disperse the incendiary substance 200. The pyogenic substance 210 is projected by the pressure wave of the explosion of the slug 150 towards the incendiary substance 200. The rearwards dispersal of the incendiary substance 200 out from the envelope is facilitated by the end wall 210 thereof being cut off. The combustion reaction of the pyrogenic substance 210 creates a very intense flash of thermal radiation which, in addition to the traumatizing effect that it may cause of itself, also serves to ignite the incendiary substance. The explosive slug also serves to disperse the lacrimatory substance 220 and to compensate the velocity with which the projectile reaches the target so as to obtain better dispersion of the pyrotechnical composition. The rearwards component of the shockwave "neutralizes" the forwards speed of the pyrotechnical composition at the instant at which it reaches the target. It should be observed, and this is an important characteristic of the invention, that the rapid and quasi-initial cutting off of the end wall 120 by means of the transverse detonating fuse 20 makes it possible subsequently for the longitudinal fuses 10 to split open and splay out the cylindrical body 110 in the form of segments that are hinged at their leading ends.

Finally, because of the way the dispersal means are organized within the pyrotechnical head, and because of the ignition sequence therefor, the invention makes it possible to disperse a pyrotechnical composition contained in the envelope in a particularly effective manner, and in particular to disperse it rearwards from the point of impact.

We claim:

1. A pyrotechnical head of the type comprising an elongate envelope including a cylindrical body that is circularly symmetrical about a longitudinal axis of symmetry, that is closed at its rear end by an end wall, a pyrotechnical composition contained in the envelope, and dispersal means for dispersing said pyrotechnical composition, wherein the dispersal means comprise an explosive slug at the front end of the envelope, longitudinal splitting means adapted to split the envelope longitudinally, said longitudinal splitting means comprising a metal sheath charged with an explosive, said sheath having a concave base outwardly directed to direct the explosive power towards the envelope and a transverse splitting means adapted to split the envelope transversely, said transverse splitting means comprising a metal sheath charged with an explosive, said sheath having a concave base outwardly directed to direct the explosive power towards the envelope, said transverse splitting means being placed at the periphery of the inside surface of the envelope in front of its end wall, wherein the transverse splitting means is adapted to cut off the rear end of the envelope transversely before the longitudinal splitting means have completely split the envelope in the longitudinal direction, such that under the effect of the longitudinal splitting means the envelope is split and opened in the form of segments that are hinged at the front, and wherein the pyrotechnical head further comprises pyrotechnical initiation means extending forwards from the rear of the envelope up to the explosive slug.

2. A pyrotechnical head according to claim 1, wherein the end wall has a shape that is generally convex towards the outside.

3. A pyrotechnical head according to claim 2 wherein said transverse splitting means is situated substantially at the junction between said cylindrical body and the end wall.

4. A pyrotechnical head according to claim 1, wherein said pyrotechnical composition comprises an incendiary substance and a pyrogenic substance adapted to ignite the incendiary substance, the two substances being placed in separate compartments inside the envelope.

5. A pyrotechnical head according to claim 4, the envelope being closed at its front end by a nose of a shape that is generally convex towards the outside, wherein said pyrogenic substance is placed in the nose of the envelope, and said incendiary substance is placed in the cylindrical body of the envelope.

6. A pyrotechnical head according to claim 5, wherein said pyrotechnical composition further comprises a lacrimatory substance placed in a compartment situated in the nose of the envelope, opposite to the compartment containing the incendiary substance.

7. A pyrotechnical head according to claim 4 wherein said explosive slug is placed in front of the compartment containing said pyrogenic substance.

8. A pyrotechnical head according to claim 6, wherein the explosive slug is placed between the compartment containing the lacrimatory substance and the compartment containing the pyrogenic substance.

9. A pyrotechnical head according to claim 1, wherein the longitudinal splitting means are placed on the inside surface of the envelope.

10. A pyrotechnical head according to claim 1, wherein said pyrotechnical initiation means are placed in the center of the envelope and extend along said axis of symmetry of the envelope.

11. A pyrotechnical head according to claim 1, wherein the transverse splitting means is placed in the proximity of at least one longitudinal splitting means in such a manner that the transverse splitting means is initiated by the longitudinal splitting means.

12. A pyrotechnical head according to claim 11 wherein the transverse splitting means is placed at a distance from the rear axial end of the longitudinal splitting means.

13. A pyrotechnical head according to claim 12 wherein the transverse splitting means is placed at a distance from the rear axial ends of the longitudinal splitting means lying in the range one-fourth to one-eight of the length thereof.

14. A pyrotechnical head according to claim 1 wherein said pyrotechnical initiation means are placed in the proximity of the longitudinal splitting means in such a manner that said pyrotechnical initiation means initiate the longitudinal splitting means which in turn initiate the transverse splitting means.

15. A pyrotechnical head according to claim 9, wherein the longitudinal splitting means extends in a plane that contains the axis of symmetry of the envelope.

* * * * *